US010046387B2

(12) United States Patent
Bishenden

(10) Patent No.: US 10,046,387 B2
(45) Date of Patent: Aug. 14, 2018

(54) DIE CASTING MACHINE PERMITTING REDUCED CYCLE TIME

(71) Applicant: EXCO ENGINEERING, A DIVISION OF EXCO TECHNOLOGIES LIMITED, Newmarket (CA)

(72) Inventor: Warren J. Bishenden, Newmarket (CA)

(73) Assignee: Exco Engineering, a Division of Exco Technologies Limited, Newmarket (CA)

( * ) Notice: Subject to any disclaimer, the term of this patent is extended or adjusted under 35 U.S.C. 154(b) by 0 days.

(21) Appl. No.: 15/253,053

(22) Filed: Aug. 31, 2016

(65) Prior Publication Data

US 2018/0056381 A1 Mar. 1, 2018

(51) Int. Cl.

| | |
|---|---|
| ***B22D 17/00*** | (2006.01) |
| ***B22D 17/08*** | (2006.01) |
| ***B22D 17/20*** | (2006.01) |
| ***B22D 17/22*** | (2006.01) |
| ***B22D 17/32*** | (2006.01) |

(52) U.S. Cl.

CPC ..... *B22D 17/2236* (2013.01); *B22D 17/002* (2013.01); *B22D 17/08* (2013.01); *B22D 17/2015* (2013.01); *B22D 17/32* (2013.01)

(58) Field of Classification Search

CPC ..... B22D 17/00; B22D 17/08; B22D 17/20; B22D 17/22; B22D 17/26; B22D 17/32; B22D 17/002; B22D 17/2015; B22D 17/2236

USPC ..... 164/113, 137, 340, 341

See application file for complete search history.

(56) References Cited

U.S. PATENT DOCUMENTS

| | | | | |
|---|---|---|---|---|
| 4,206,799 | A * | 6/1980 | McDonald | B22D 17/2236 164/341 |
| 5,701,947 | A | 12/1997 | Bishenden | |
| 5,865,241 | A | 2/1999 | Bishenden et al. | |
| 7,500,508 | B2 * | 3/2009 | Heinrich et al. | B22D 17/24 164/312 |
| 7,669,639 | B2 * | 3/2010 | Whealy et al. | B22D 17/2218 164/340 |

* cited by examiner

*Primary Examiner* — Kevin P Kerns

(74) *Attorney, Agent, or Firm* — Fishman Stewart PLLC

(57) ABSTRACT

A die casting machine includes a stationary die half, an ejector holder block, and die core pieces that extend through the ejector holder block, defining a die cavity when closed. An ejector box backstops the closed ejector holder block and die core pieces. Melt is injected into the die cavity. After a first dwell time, the ejector box is retracted away from the ejector holder block while a closing force is simultaneously applied to maintain the ejector holder block closed on the stationary die half, and the die core pieces are retracted out of the die cavity. After a second dwell time, the melt completely freezes and the ejector block is separated from the stationary die half, opening the die cavity from which the resulting die cast block can be retrieved.

15 Claims, 7 Drawing Sheets

DIE CASTING MACHINE PERMITTING REDUCED CYCLE TIME

TECHNICAL FIELD

This relates to a die casting machine and to a method for die casting.

BACKGROUND

U.S. Pat. No. 5,865,241, which issued Feb. 2, 1999 to Exco Technologies Limited, discloses a three-part die casting machine for casting engine blocks with an ejector holder block that closes on a stationary die half, and an ejector box that moves to backstop the ejector holder block. Die core pieces in the ejector holder block (used to form piston cylinder bores) slide at an acute angle to the direction of movement of the holder block. With the die core pieces extended, hydraulic cylinders between the ejector box and ejector holder block retract the ejector holder block rearwardly into abutment with the ejector box. Thereafter, a hydraulic cylinder pushes the ejector box and the mated ejector holder block against the stationary die half to form a die cavity between the stationary die half and the ejector holder block which is further defined by the extended die core pieces. In this closed position, the ejector box backstops the die core pieces to lock the die core pieces in their extended position. After casting, the die cavity is opened along the main parting line between the ejector holder block and the stationary die half. Once the ejector holder block has been retracted from the stationary die half to a sufficient extent, the hydraulic cylinders connecting the ejector box and the ejector holder block push the ejector holder block forward away from the ejector box to allow withdrawal of the die core pieces.

The die core pieces of the described die casting machine have a typical service life of about 8,000 cycles. It would be desirable to increase the service life of the die core pieces. It would also be desirable to reduce the cycle time of the die casting machine.

SUMMARY

According to an aspect, there is provided a method for die casting in a die casting machine that has a stationary die half, an ejector holder block which, when closed on the stationary die half at least partially forms a die cavity, one or more die core pieces that extend through the ejector holder block which, when in an extended position, further define the die cavity, and an ejector box to backstop the ejector holder block and the one or more die core pieces when in the extended position. The method includes, when the ejector holder block is closed on the stationary die half, the one or more die core pieces are in the extended position, and the ejector box backstops the ejector holder block and the one or more die core pieces, retracting the ejector box away from the ejector holder block while simultaneously applying a closing force to maintain the ejector holder block closed on the stationary die half, and retracting the one or more die core pieces from the extended position to a retracted position outside of the die cavity.

According to another aspect, there is provided a die casting machine that includes a stationary die half; an ejector holder block mounted for movement forwardly toward and rearwardly away from the stationary die half such that the ejector holder block may be moved forwardly to a closed position forming, with the stationary die half, a die cavity; at least one die core piece that is slidably mounted in the ejector holder block for movement, in a direction that is an acute angle to the direction of movement of the ejector holder block, between an extended position and a retracted position such that when the ejector holder block is in the closed position and the at least one die core piece is in the extended position, the die cavity is further defined; a moveable ejector box that is mounted rearwardly of the ejector holder block for movement forwardly toward and rearwardly away from the stationary die half; a forward face of the moveable ejector box having a surface abutting a rear surface of the at least one die core piece when the at least one die core piece is in the extended position and the moveable ejector holder block is in abutment with the ejector box so as to lock the at least one die core piece in the extended position; at least one actuator for moving the ejector box forwardly toward and rearwardly away from the stationary die half; and a spacing controller for controlling spacing between the ejector box and the ejector holder block.

Other features will become apparent from the drawings in conjunction with the following description.

BRIEF DESCRIPTION OF THE DRAWINGS

In the figures which illustrate example embodiments.

DETAILED DESCRIPTION

The die casting machine described herein in conjunction with the figures is adapted to cast V-6 automobile cylinder blocks.

Figure 1:
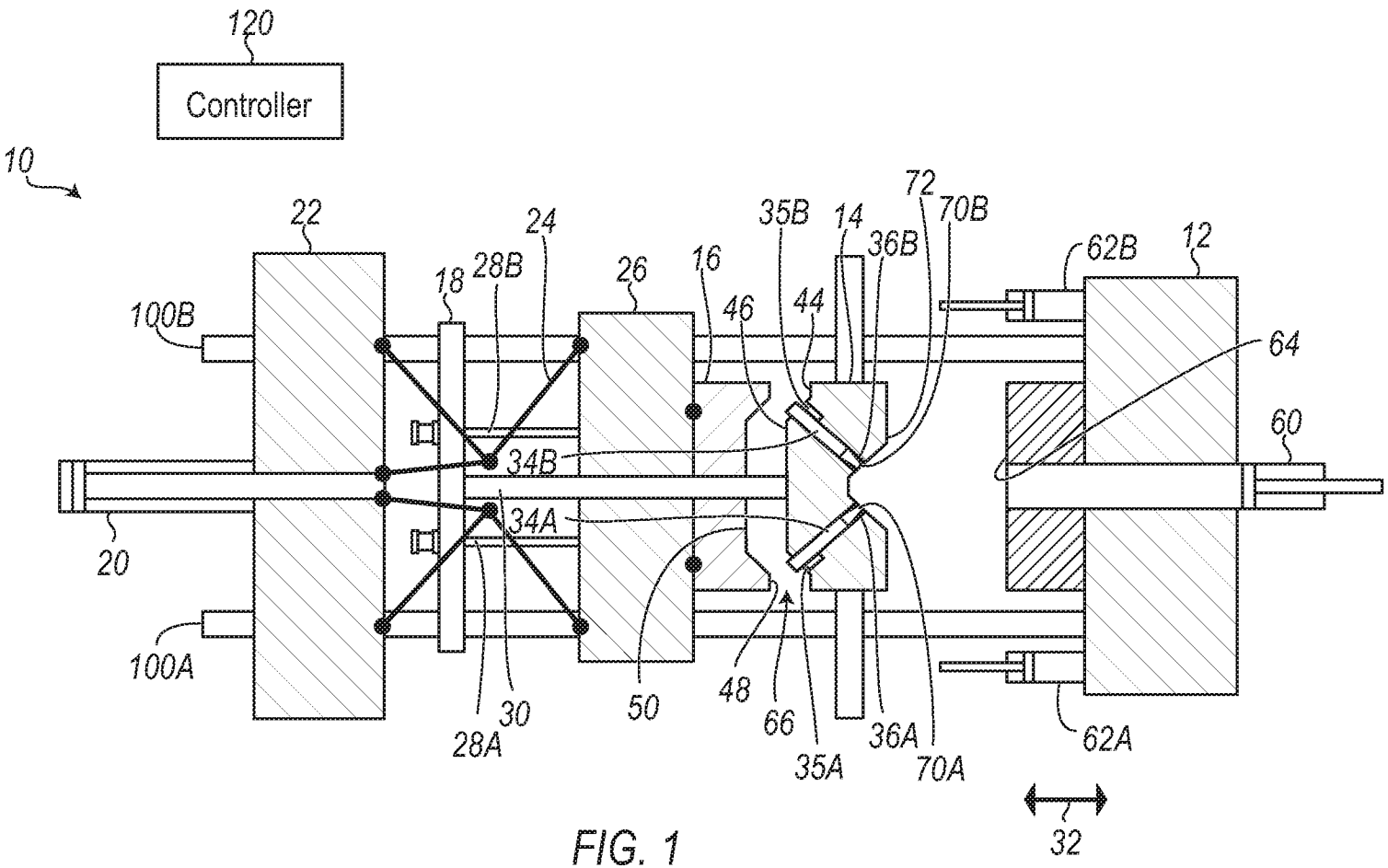
FIG. 1 is a simplified top schematic view of a die casting machine in an open position, exemplary of an embodiment.

FIG. 1 is a simplified top schematic view of a die casting machine 10 in an open position. Die casting machine 10 comprises a stationary die half 12 and a stationary back plate 22. Tie rods 100A, 100B tie the stationary die half 12 to the stationary back plate 22. An ejector holder block 14, an ejector box 16 with an attached platen 26, and an ejector plate 18 slide along the tie rods 100A, 100B. An actuator in the form of a main cylinder 20 is mounted on the stationary back plate 22. Main cylinder 20 is connected, via a four-bar linkage 24, to the moving platen 26, so as to be able to move ejector box 16 in a linear direction indicated at 32 forwardly toward or rearwardly away from stationary die half 12. A tie rod 30 rigidly ties ejector plate 18 to ejector holder block 14 for maintaining a fixed spacing between ejector plate 18 and ejector holder block 14. Control cylinders 28A, 28B are retracting cylinders mounted between ejector plate 18 and moving platen 26.

In an open position, the distance between ejector holder block 14 and front face 64 of the stationary die half 12 may be, for example, 40 inches, and the distance between ejector box 16 and ejector holder block 14 may be, for example, 8 inches.

Obliquely mounted die core pieces 34A, 34B with die cavity forming ends 70A, 70B are received within channels 36A, 36B, respectively, in ejector holder block 14 so as to be slidable in a direction making an acute angle with direction 32. Each die core piece 34A, 34B is connected to a double acting hydraulic cylinder 35A, 35B; the head of each of cylinders 35A, 35B is rigidly connected to ejector holder block 14 (connection not shown). FIG. 1 illustrates cylinders 35A, 35B mounted to ejector holder block 14 in the same plane as adjacent die core pieces 34A, 34B. In other embodiments, cylinders 35A, 35B can be mounted to ejector holder block 14 either above or below die core pieces 34A, 34B.

A rearward face 44 of ejector holder block 14 has a tapered male surface 46 and a forward face 48 of ejector box 16 has a complementary tapered female surface 50.

Hydraulic parting cylinders 62A, 62B are mounted to stationary die half 12 and project toward stationary back plate 22. As will become apparent, hydraulic parting cylinders 62A, 62B engage with ejector holder block 14 for pushing ejector holder block 14 away from stationary die half 12. Hydraulic parting cylinders 62A, 62B are push-off cylinders: they are not attached to ejector holder block 14.

An injector in the form of injection cylinder 60, which may be, for example, a hydraulic cylinder, extends through the stationary die half 12 to the front face 64 of the stationary die half 12. The operation of the various cylinders and the injector are controlled by controller 120, which may be, for example, a programmable logic controller (PLC).

Figure 2:
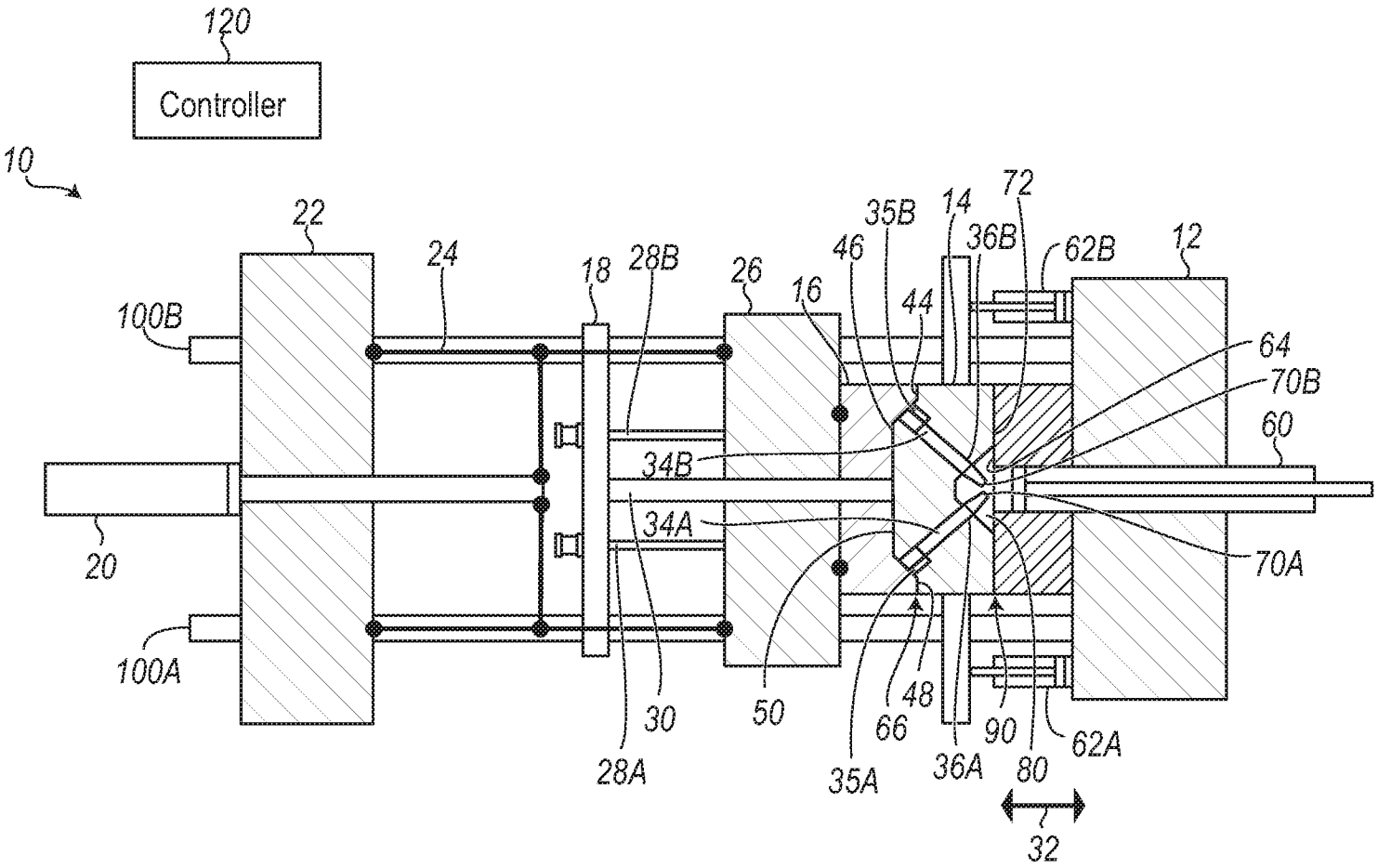
FIG. 2 is a simplified top schematic view of the die casting machine of FIG. 1 in a closed position.
Figure 3:
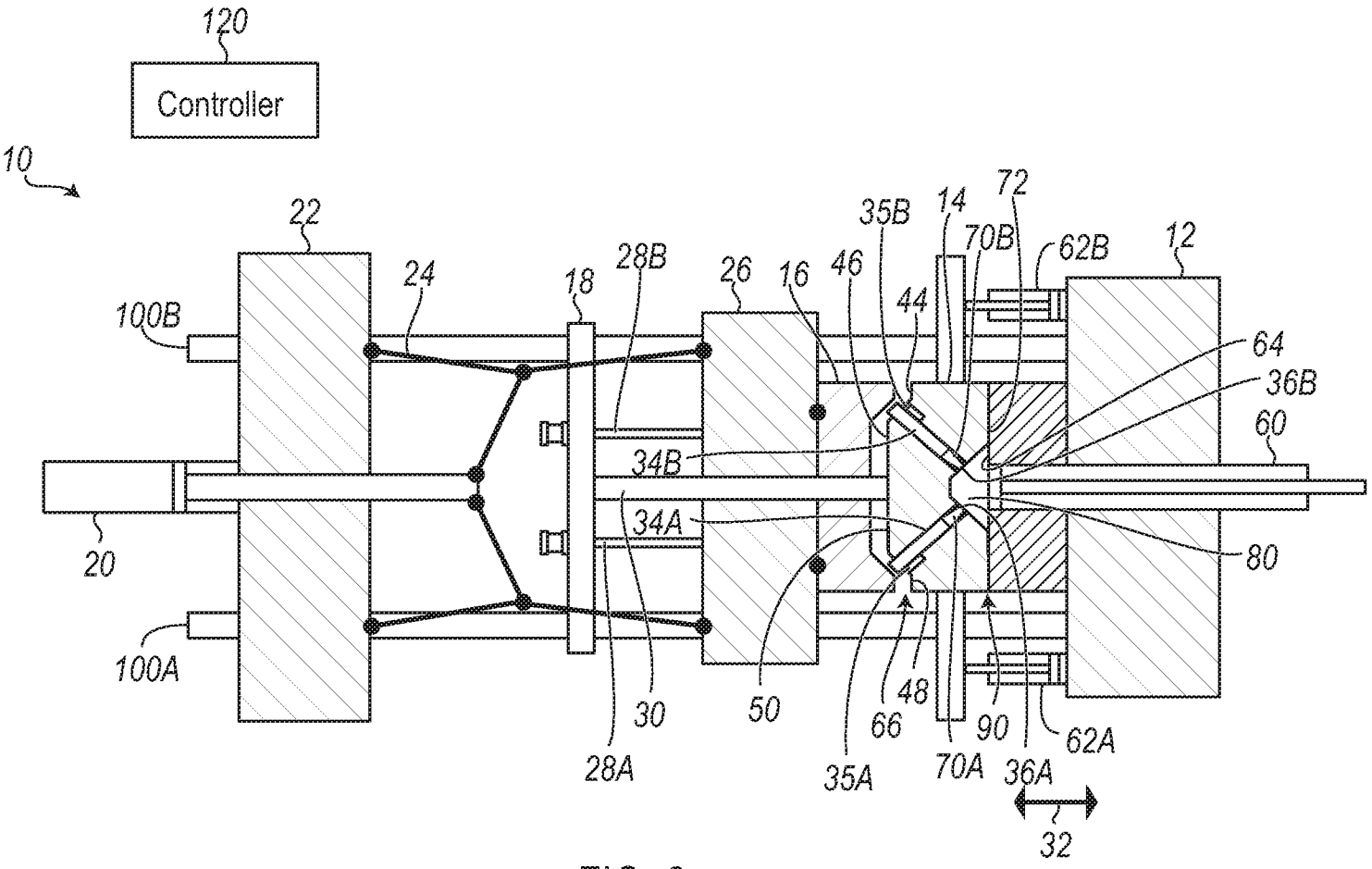
FIG. 3 is a simplified top schematic view of the die casting machine of FIG. 1 in an intermediate position.
Figure 4:
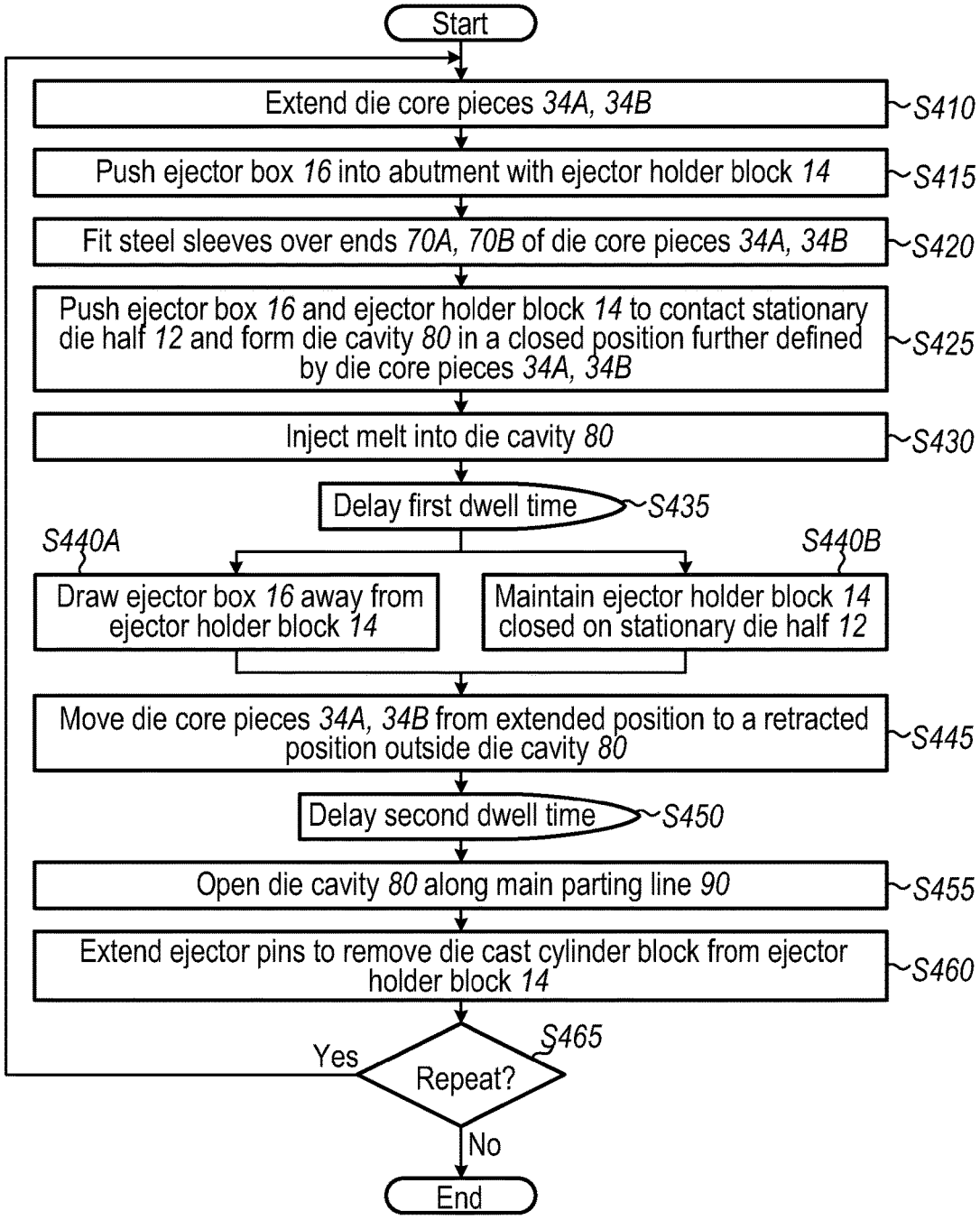
FIG. 4 is a flow chart of a method of operating the die casting machine of FIG. 1.

In operation, die casting machine 10 cycles from the open position as illustrated in FIG. 1, to a closed position as illustrated in FIG. 2, then to an intermediate position as illustrated in FIG. 3, and then returns to the open position of FIG. 1. The operation of die casting machine 10 is described with reference to the flowchart of FIG. 4.

With the die casting machine 10 in the open position illustrated in FIG. 1, gap 66 between ejector holder block 14 and ejector box 16 permits access to the interface between hydraulic cylinders 35A, 35B and their respective die core pieces 34A, 34B which allows removal of each die core piece from its hydraulic cylinder to permit exchange of die core pieces 34A, 34B.

With appropriate die core pieces 34A, 34B in place in die casting machine 10, controller 120 controls cylinders 35A, 35B to extend to move die core pieces 34A, 34B to their extended position (S410). In this extended position, the rearward end of each die core piece sits flush with tapered male surface 46 of ejector holder block 14.

Next, main cylinder 20 pushes four-bar linkage 24, causing moving platen 26 and ejector box 16 to be pushed into abutment with ejector holder block 14 (S415). With ejector box 16 abutting ejector holder block 14, male surface 46 of ejector holder block 14 mates with female surface 50 of ejector box 16. This precisely locates ejector holder block 14 with respect to ejector box 16. Further, when ejector box 16 is pushed into abutment with ejector holder block 14, forward surface 48 of ejector box 16 acts as a backstop for die core pieces 34A, 34B, locking them in their extended position. In their extended position, die cavity forming ends 70A, 70B of die core pieces 34A, 34B, respectively, protrude from forward face 72 of ejector holder block 14.

In an alternate embodiment, rather than the main cylinder 20 pushing the moving platen 26 and ejector box 16 into abutment with the ejector holder block 14, if control cylinders 28A, 28B are double acting, they can be extended which, due to the larger mass of the platen 26 relative to the ejector holder block 14 and ejector plate 18, will draw the ejector holder block 14 rearwardly into abutment with ejector box 16.

In forming an automotive cylinder block, ends 70A, 70B of the die core pieces form the cylinder bores of the die cast cylinder block. If it is desired to line these cylinder bores with steel sleeves, once die core pieces 34A, 34B are in their extended position, steel sleeves (not shown) are fitted over the ends 70A, 70B by a human operator or a robot, with or without a vision locating system (S420).

Next, main cylinder 20 extends further to push the four-bar linkage 24 into its fully extended position which forces ejector box 16 and mated ejector holder block 14 against stationary die half 12 (S425). This is the closed position of the die casting machine 10 which is illustrated in simplified form in FIG. 2.

In the closed position, ejector holder block 14 and stationary die half 12 define a die cavity 80.

Injection cylinder 60 then operates to apply an injection force to inject melt, such as molten metal, into die cavity 80 with a force typically ranging between 10,000 and 13,000 PSI (S430).

Forward surface 48 of ejector box 16, by abutting the rearward surface of die core pieces 34A, 34B, prevents die core pieces 34A, 34B from being blown out of die cavity 80 during injection.

After a first dwell time (S435), pressure in main cylinder 20 is relieved, and control cylinders 28A, 28B begin to retract. These cylinders act between ejector plate 18 and platen 26 with ejector box 16. However, ejector plate 18 cannot advance since it is tied to ejector holder block 14 which abuts the stationary die half 12. Therefore, instead platen 26 with ejector box 16 is drawn rearwardly by these cylinders, which draws the ejector box 16 away from the ejector holder block 14 (S440A), and causes the four-bar linkage 24 to begin to collapse. Furthermore, the reaction force from control cylinders 28A, 28B on ejector plate 18 is transferred through tie rod 30 to ejector holder block 14 and helps maintain the die cavity 80 closed.

Cylinder 20 now begins to draw back on the four-bar linkage 24 which draws the platen 26 with ejector box 16 further away from the ejector holder block 14. In order to maintain the die cavity 80 closed, simultaneously, control cylinders 28A, 28B retract at a rate equal and opposite to the rate at which the four-bar linkage 24, motivated by cylinder 20 draws the ejector box 16 away from the ejector holder block 14. This maintains ejector plate 18, to which control cylinders 28A, 28B are mounted, stationary relative to stationary die half 12 (S440B). In consequence, because ejector plate 18 is rigidly tied to ejector holder block 14 by tie rod 30, ejector holder block 14 also remains stationary relative to stationary die half 12. Thus, the ejector plate 18 acts to maintain die cavity 80 closed.

Injection cylinder 60 ceases to apply an injection force to reduce pressure in the die cavity 80 and therefore alleviate an opening force on ejector holder block 14.

With ejector holder block 14 held stationary and ejector box 16 drawn away from ejector holder block 14, ejector box 16 parts from ejector holder block 14 so that they are no longer mated, and forward surface 48 of ejector box 16 no longer acts as a backstop for die core pieces 34A, 34B.

The die cavity 80 cannot be opened until the last region of melt to freeze has frozen. The first dwell time is chosen such that by the time ejector box 16 has been drawn away from ejector holder block 14, the melt has frozen in the region of the die core pieces 34A, 34B so that the die core pieces can be retracted from die cavity 80 without damaging the casting. At this point, cylinders 35A, 35B retract die core pieces 34A, 34B from their extended position to their retracted position, thus removing die core pieces 34A, 34B from die cavity 80 (S445). This intermediate position of the die casting machine 10 is illustrated in simplified form in FIG. 3.

Following removal of die core pieces 34A, 34B from die cavity 80, operation pauses for a second dwell time (S450) which allows the melt to completely freeze. After the second dwell time, main cylinder 20 retracts, pulling on ejector box 16 through linkage 24 and platen 26. While the main cylinder 20 is retracting, the control cylinders 28A, 28B are kept at a fixed extension so that the pulling force from the main cylinder 20 is transmitted through tie bar 30 as an opening force on the ejector holder block 14. At the same time, injection cylinder 60 applies an injection force to pressurize die cavity 80 which applies a further opening force on the ejector holder block 14. Additionally, parting cylinders 62A, 62B are operated to push against the ejector holder block 14. These opening forces cause the die cavity 80 to open along the main parting line 90. The parting cylinders 62A, 62B relieve the main cylinder 20, and the parts acted on by the main cylinder 20, from the heavy cycle force required to part the ejector holder block 14 from the stationary die half 12. Once the ejector holder block 14 has parted from the stationary die half 12, a lesser force is required to continue to move the ejector holder block 14 away from the stationary die half 12. In this regard, as the ejector holder block 14 opens further toward its opened position of FIG. 1 (S455), parting cylinders 62A, 62B no longer contact ejector holder block 14.

Ejector pins (not shown) of ejector holder block 14 then extend to push the die cast cylinder block from ejector holder block 14 (S460).

If an additional die cast cylinder block is to be cast, the die cycles again in the manner described (S465).

By removing die core pieces 34A, 34B from die cavity 80 in advance of the melt in die cavity 80 completely freezing, and therefore prior to die cavity 80 being opened along main parting line 90, the cycle time for the die casting process can be reduced. This is because certain steps in opening the die, namely, the steps of drawing the ejector box 16 away from ejector holder block 14 and removing the die core pieces 34A, 34B from die cavity 80, occur while the melt is completing its freeze. This may result in a cycle time reduction of 8 or more seconds, providing a 6% or more cycle time improvement, over conventional methods.

Furthermore, by removing die core pieces 34A, 34B from die cavity 80 early, die core pieces 34A, 34B are subjected to a lower heat load. This can lengthen the life of the die core pieces 34A, 34B. Also, if the die core pieces are overheated, melt proximate the die core pieces will not freeze as readily and may stick to the die core pieces 34A, 34B when they are removed. Removing the die core pieces 34A, 34B early keeps them cooler and so reduces the possibility of overheated melt sticking to the die core pieces 34A, 34B when they are removed.

Figure 5:
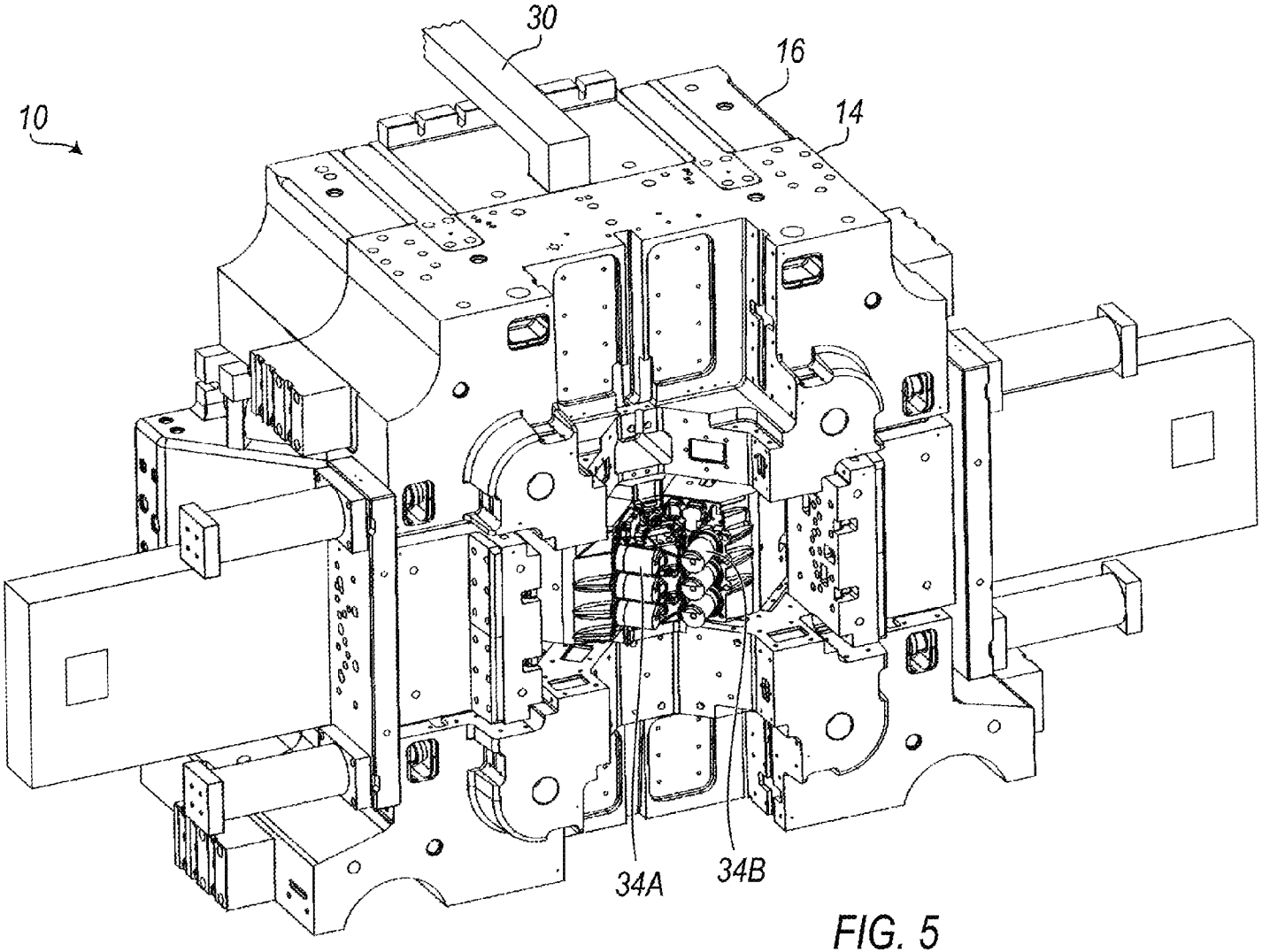
FIG. 5 is a perspective view of a portion of a die casting machine, exemplary of an embodiment.

FIG. 5 is a perspective view of a portion of die casting machine 10 in the closed position.

Figure 6:
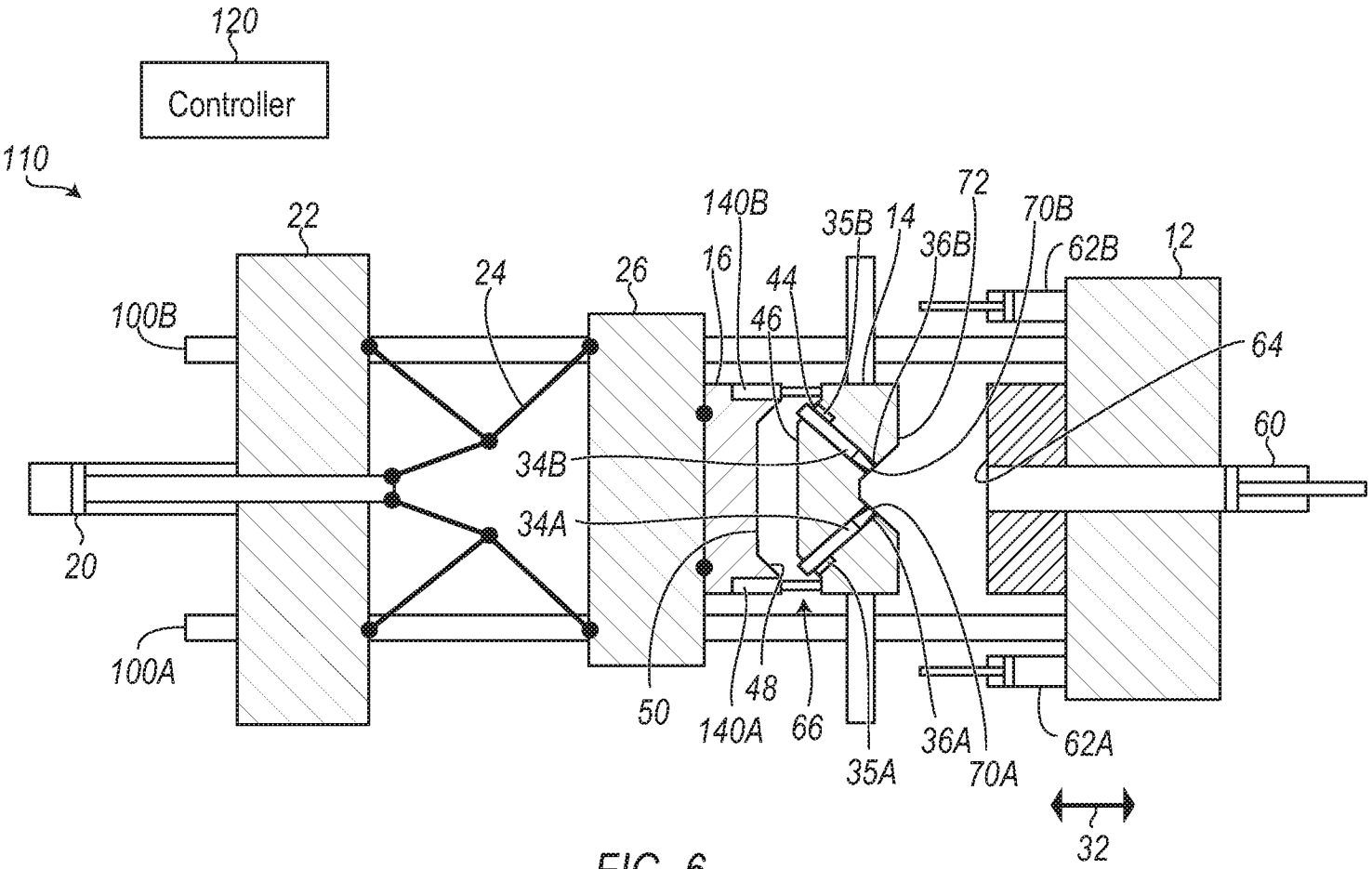
FIG. 6 is a simplified top schematic view of a die casting machine in an open position, exemplary of an embodiment.

FIG. 6 illustrates a simplified top schematic view of an alternative embodiment of a die casting machine 110 in an open position, in which like elements have like numbering. In the alternative embodiment illustrated, instead of a moving platen 18, tie rod 30, and control cylinders 28A, 28B present in die casting machine 10, die casting machine 110 has double acting side cylinders 140A, 140B, between ejector box 16 and ejector holder block 14.

In operation, similarly to the first embodiment, controller 120 controls cylinders 35A, 35B to extend to move die core pieces 34A, 34B to their extended position whereat the rearward end of each die core piece sits flush with tapered male surface 46 of ejector holder block 14.

Figure 7:
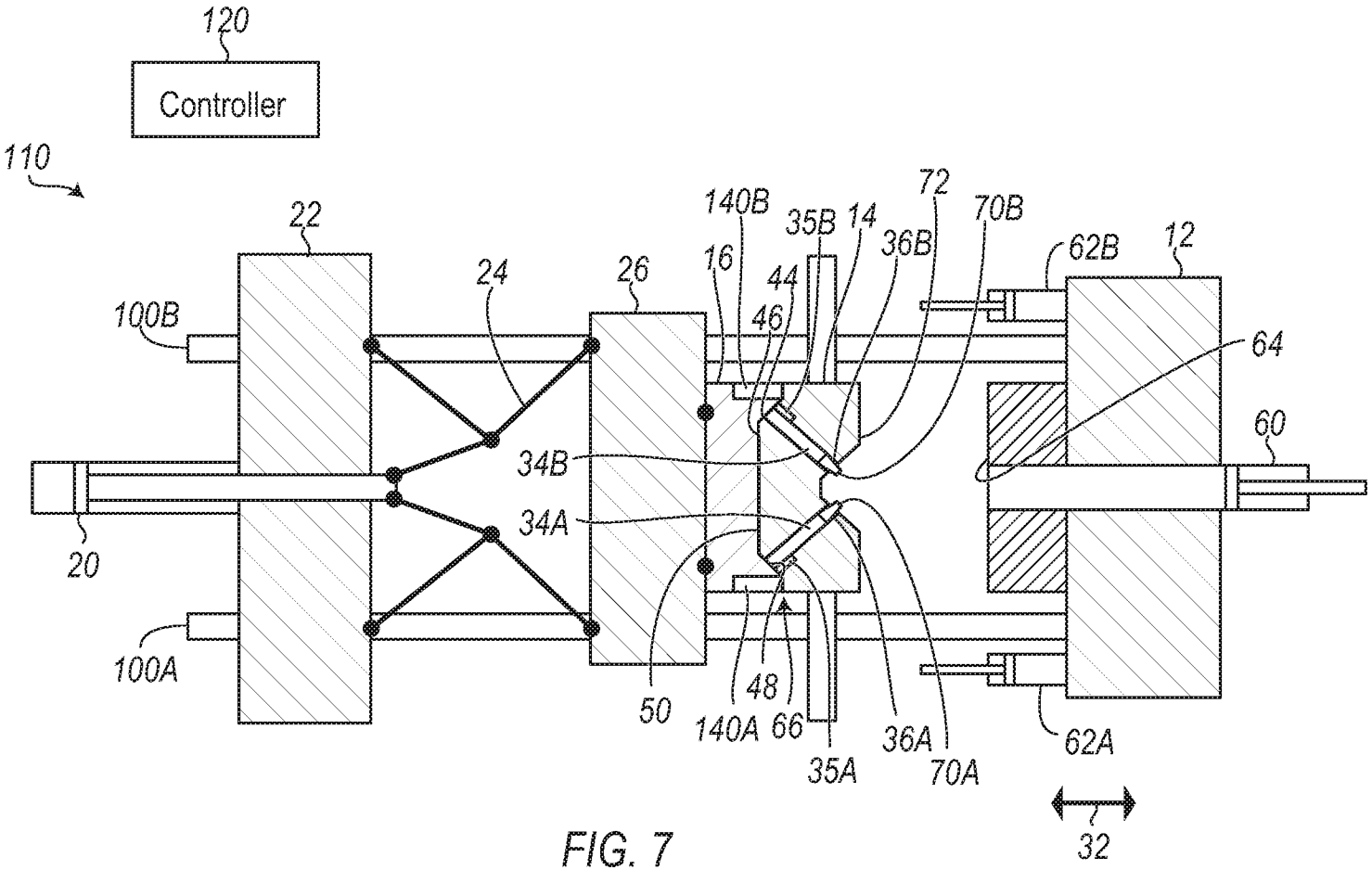
FIG. 7 is a simplified top schematic view of the die casting machine of FIG. 6 in an intermediate position.

Next, side cylinders 140A, 140B retract, drawing ejector holder block 14 rearwardly into abutment with ejection box 16 so that, as with the first embodiment, the mating surfaces of the ejector holder block 14 and ejector box 16 precisely determines their relative positioning and forward surface 48 of ejector box 16 acts as a backstop for die core pieces 34A, 34B. This intermediate position of the die casting machine 110 is illustrated in simplified form in FIG. 7.

Next, main cylinder 20 extends to push the four-bar linkage 24 into its fully extended position which forces ejector box 16 and mated ejector holder block 14 against stationary die half 12. This is the closed position of the die casting machine 110 (not shown).

With die casting machine 110 in a closed position, the injection cylinder 60 is operated to inject melt. After a first dwell time, pressure in main cylinder 20 is relieved, and side cylinders 140A, 140B extend, pushing ejector box 16 away from ejector holder block 14. The resulting reaction force on ejector holder block 14 helps maintain the die cavity 80 closed. Injection cylinder 60 ceases to apply an injection force to reduce pressure in the die cavity 80 to alleviate an opening force on ejector holder block 14.

With the ejector box 16 drawn away from ejector holder block 14, forward surface 48 of the ejector box 16 no longer acts as a backstop for die core pieces 34A, 34B and the die core pieces 34A, 34B can be retracted.

Following removal of die core pieces 34A, 34B from die cavity 80, operation pauses for a second dwell time which allows the melt to completely freeze. After the second dwell time, main cylinder 20 retracts, pulling on ejector box 16 through four-bar linkage 24. While the main cylinder 20 is retracting, the side cylinders 140A, 140B are kept at a fixed extension so that the pulling force from the main cylinder 20 is transmitted as an opening force on both ejector box 16 and ejector holder block 14. At the same time, injection cylinder 60 applies an injection force to pressurize die cavity 80 which applies a further opening force on the ejector holder block 14. Additionally, parting cylinders 62A, 62B are operated to push ejector holder block 14 away from stationary die half 12. This causes the die cavity 80 to open along the main parting line 90.

Any of the hydraulic cylinders described in conjunction with die casting machine 10 or 110 may be replaced by another linear actuator, such as a linear motor, or a rotary motor terminating in a pinion engaging a rack.

In some embodiments, four-bar linkage 24 may be replaced with a double acting hydraulic cylinder and locks.

While die casting machine 10 and 110 are adapted to cast V-6 automobile engine blocks, in other embodiments the features described may be applied to die casting machines for casting V-4, V-8 or V-12 engine blocks, in-line cylinder engine blocks, or other parts.

Of course, the above described embodiments are intended to be illustrative only and in no way limiting. The described embodiments are susceptible to many modifications of form, arrangement of parts, details and order of operation. This is intended to encompass all such modifications within the scope as defined by the claims.

What is claimed is:

1. A method for die casting in a die casting machine having a stationary die half, an ejector holder block which, when closed on said stationary die half at least partially forms a die cavity, one or more die core pieces extending through said ejector holder block which, when in an extended position, further define said die cavity, and an ejector box to backstop said ejector holder block and said one or more die core pieces when in said extended position, said method comprising:

when said ejector holder block is closed on said stationary die half, said one or more die core pieces are in said extended position, and said ejector box backstops said ejector holder block and said one or more die core pieces, retracting said ejector box away from said ejector holder block while simultaneously applying a closing force to maintain said ejector holder block closed on said stationary die half; and retracting said one or more die core pieces from said extended position to a retracted position outside of said die cavity.

2. The method of claim 1, wherein said applying a closing force comprises:

providing an ejector plate outboard of said ejector box, said ejector plate rigidly tied to said ejector holder block so as to maintain a fixed spacing between said ejector plate and said ejector holder block, and drawing said ejector box toward said ejector plate and away from said ejector holder block so that said ejector plate and said ejector holder block maintain a fixed spacing from said stationary die half while said ejector box is retracted.

3. The method of claim 2, wherein said drawing said ejector box toward said ejector plate comprises retracting a control cylinder acting between said ejector plate and said ejector box.

4. The method of claim 1, wherein retracting said ejector box away from said ejector holder block comprises extending a side cylinder between said ejector box and said ejector holder block.

5. The method of claim 1, further comprising, prior to retracting said ejector box away from said ejector holder block, injecting melt into said die cavity by applying an injection force.

6. The method of claim 5, further comprising refraining from applying said injection force when applying said closing force.

7. The method of claim 6, further comprising, after said retracting said one or more die core pieces, ceasing to apply said closing force and applying said injection force to urge said ejector holder block out of said die closed position, away from said stationary die half.

8. The method of claim 1, further comprising, after said retracting said one or more die core pieces, actuating a parting cylinder to move said ejector holder block away from said stationary die half.

9. The method of claim 1, wherein retracting said one or more die core pieces comprises moving said one or more die core pieces from said extended position to said retracted position.

10. A method for die casting in a die casting machine having, in a closed position, an ejector holder block abutting a stationary die half along a main parting line to partially form a die cavity and die core pieces carried by said ejector holder block positioned in an extended position to further define said die cavity, said method comprising:

backstopping said ejector holder block and said die core pieces in said closed position with a backstop;

injecting melt;

withdrawing said backstop;

withdrawing said die core pieces from said die cavity in advance of opening said die cavity along said main parting line; and subsequently opening said die cavity along said main parting line.

11. The method of claim 10, further comprising applying a closing force to maintain said die cavity closed along said main parting line while withdrawing said backstop.

12. The method of claim 11, further comprising applying a primary force to said backstop while applying a melt injection force to inject melt into said cavity, and wherein said withdrawing said backstop comprises ceasing to apply said primary force.

13. The method of claim 12, further comprising:

while applying said closing force, ceasing to apply said melt injection force.

14. The method of claim 13, further comprising assisting said opening by re-applying said melt injection force.

15. The method of claim 10, further comprising pausing for a dwell time after withdrawing said die core pieces and prior to said opening.

* * * * *